US011508342B2

(12) United States Patent
Thorn et al.

(10) Patent No.: US 11,508,342 B2
(45) Date of Patent: Nov. 22, 2022

(54) SHOULDER REST WITH HAPTIC FEEDBACK

(71) Applicants: Seth D. Thorn, Scottsdale, AZ (US); Byron Lahey, Scottsdale, AZ (US)

(72) Inventors: Seth D. Thorn, Scottsdale, AZ (US); Byron Lahey, Scottsdale, AZ (US)

(73) Assignee: Arizona Board of Regents on behalf of Arizona State University, Scottsdale, AZ (US)

( * ) Notice: Subject to any disclaimer, the term of this patent is extended or adjusted under 35 U.S.C. 154(b) by 0 days.

(21) Appl. No.: 16/896,798

(22) Filed: Jun. 9, 2020

(65) Prior Publication Data

US 2020/0394987 A1 Dec. 17, 2020

Related U.S. Application Data

(60) Provisional application No. 62/861,870, filed on Jun. 14, 2019.

(51) Int. Cl.
*G10D 3/18* (2020.01)
*G10G 5/00* (2006.01)

(52) U.S. Cl.
CPC ..... *G10D 3/18* (2013.01); *G10G 5/005* (2013.01); *G10H 2220/525* (2013.01)

(58) Field of Classification Search
CPC ..... G10D 3/18; G10G 5/005; G10H 2220/525
See application file for complete search history.

(56) References Cited

U.S. PATENT DOCUMENTS

2007/0084335 A1* 4/2007 Silzel ..... G10H 3/146 84/723
2016/0005388 A1* 1/2016 Huang ..... G10G 7/00 84/727
2016/0140941 A1* 5/2016 Kobayashi ..... G10F 1/16 84/3
2018/0277084 A1* 9/2018 Connell ..... G10H 1/02
2018/0330699 A1* 11/2018 Buttemer ..... G10G 1/00
2020/0160750 A1 5/2020 Likamwa et al.

FOREIGN PATENT DOCUMENTS

JP 2638287 B2 * 8/1997

OTHER PUBLICATIONS

Seth Thorn, Shoulder Rest with Haptic Feedback, https://vimeo.com/305282476 , Dec. 8, 2018; viewed online on May 4, 2022 (Year: 2018).*

P. R. Cook, "Remutualizing the Musical Instrument: Co-Design of Synthesis Algorithms and Controllers," Journal of New Music Research, vol. 33, No. 3, pp. 315-320, 2004.

(Continued)

*Primary Examiner* — Jianchun Qin
(74) *Attorney, Agent, or Firm* — Snell & Wilmer L.L.P.

(57) ABSTRACT

Disclosed herein are various embodiments of haptic systems for digital musical instruments. In embodiments, the haptic systems comprise a shoulder rest that has been modified with haptic elements capable of generating a feedback signal to a user of a digital musical instrument.

18 Claims, 3 Drawing Sheets

(56) References Cited

OTHER PUBLICATIONS

D. Overholt, "Violin-Related HCI: A Taxonomy Elicited by the Musical Interface Technology Design Space," Lecture Notes of the Institute for Computer Sciences, Social Informatics and Telecommunications Engineering Arts and Technology, pp. 80-89, 2012.
S. D. Thorn, "Alto.glove: New Techniques for Augmented Violin," Proceedings of the 2018 International Conference for New Interfaces for Musical Expression, Blacksburg, 2018, pp. 334-339.
S. D. Thorn, "Transference: A Hybrid Computational System for Improvised Violin Performance," Proceedings of the 13th International Conference on Tangible, Embedded and Embodied Interaction, Tempe, 2019.
C. Cadoz, "Supra-Instrumental Interactions and Gestures," Journal of New Music Research, vol. 38, No. 3, pp. 215-230, 2009.
S. Emmerson, "Aural landscape: musical space," Organised Sound, vol. 3, No. 2, pp. 135-140, 1998.
B. Rovan and J. Hayward, "Typology of Tactile Sounds and their Synthesis in Gesture-Driven Computer Music Performance," Trends in Gestural Control of Music. M. Wanderley and M. Battier, Eds. Paris: IRCAM, 2000.
Vimeo. 2020. Shoulder Rest With Haptic Feedback, [online] Available at: <https://vimeo.com/305282476> [Dec. 8, 2018].
C. Nichols, "The vBow: a virtual violin bow controller for mapping gesture to synthesis with haptic feedback," Organised Sound, vol. 7, No. 02, 2002.
A. Luciani, J. Florens, D. Couroussé, and C. Cadoz, "Ergotic Sounds: A New Way to Improve Playability, Believability and Presence of Digital Musical Instruments," 4th International Conference on Enactive Interfaces, Grenoble, 2007.
"Violinist.com interview with Aaron Rosand, Part 1," Violinist.com. [Online]. Available: https://www.violinist.com/blog/aurie/20148/16066/. [Accessed: Nov. 27, 2018].
M. Marshall and M. Wanderley, "Vibrotactile Feedback in Digital Musical Instruments," Proceedings of the 2006 International Conference on New Interfaces for Musical Expression, Paris, 2006, pp. 226-229.
L. Hayes and C. Michalakos, "Imposing a Networked Vibrotactile Communication System for Improvisational Suggestion," Organised Sound, vol. 17, No. 01, pp. 36-44, 2012.

* cited by examiner

SHOULDER REST WITH HAPTIC FEEDBACK

CROSS-REFERENCE TO RELATED APPLICATIONS

This application is a non-provisional application of, and claims priority to, U.S. Provisional Pat. App. No. 62/861,870 filed Jun. 14, 2019 and entitled "Shoulder Rest with Haptic Feedback," which is incorporated herein by reference in its entirety (except for any subject matter disclaimers or disavowals, and except to the extent of any conflict with the express disclosure of the present application, in which case the disclosure of the present application shall control).

TECHNICAL FIELD

The present disclosure relates to haptics, and in particular to haptic feedback utilized in connection with musical performance.

BACKGROUND

Prior devices utilized in connection with musical performance, for example a shoulder rest for a violin, can be enhanced in digital performance contexts via the addition of haptic feedback. For example, when a violin is digitally augmented, audio feedback for the performer from a remote loudspeaker creates an unnatural "feel" for the performer due to the remoteness of the sound diffusion from the instrument driving the sound generation. Accordingly, improved devices and systems for haptic feedback in musical performance remain desirable.

SUMMARY

In an aspect, a shoulder rest for a digital musical instrument is provided, comprising: a body comprising a rigid or semi-rigid material; and a haptic element coupled to the body of the shoulder rest, wherein the haptic element generates a haptic feedback signal responsive to a user playing the digital musical instrument.

In embodiments, the digital musical instrument is a digitally augmented violin. In embodiments, the shoulder rest further comprises an amplifier coupled to an input of the haptic element and to an output of the digital musical instrument. In embodiments, the haptic element is a voice coil. In embodiments, the shoulder rest further comprises a second haptic element coupled to the body.

In an aspect, a method of providing feedback to a performer utilizing a digital musical instrument is provided, the method comprising: coupling at least one haptic element to a shoulder rest; receiving an output of the digital musical instrument; processing the output to create an input signal for the haptic element; and driving the haptic element, using the input signal, to provide feedback to the performer.

In embodiments, the method further comprises providing, to the performer, a metronome pulse via the haptic element. In embodiments, the method further comprises providing, to the performer, a group performance signal via the haptic element. In embodiments, the group performance signal comprises at least one of: a key change signal; a tempo change signal; an articulation signal; a volume signal; an improvisation signal; or a song change signal. In embodiments, the processing signal comprises applying a high-pass filter having a roll-off of 1 kHz. In embodiments, the haptic element is a voice coil. In embodiments, the input signal varies based on at least one of: harmonic information in the output of the digital musical instrument; amplitude information in the output of the digital musical instrument; phase information in the output of the digital music signal; modulation information in the output of the digital musical instrument; fret noise information in the output of the digital musical instrument; percussive information in the output of the digital musical instrument; or hammer on or pull-off information in the output of the digital musical instrument.

In an aspect, a haptic feedback system is provided for a digital musical instrument comprising: a shoulder rest comprising at least one exciter fixed on the surface of the shoulder rest; a jack mounted at one end of the shoulder rest; and an amplifier coupled to the at least one exciter through the jack, wherein the at least one exciter is capable of generating haptic feedback signals to a user playing the digital musical instrument.

In embodiments, the haptic feedback system further comprises a computer, wherein output from the digital musical instrument is processed by the computer in real-time, which results in the at least one exciter generating the haptic feedback signals to the user playing the digital instrument. In embodiments, the at least one exciter is capable of receiving a metronomic pulse, which results in the at least one exciter generating haptic feedback signals to the user playing the digital musical instrument. In embodiments, the at least one exciter fixed on the surface of the shoulder rest, comprises two exciters fixed on the surface of the shoulder rest. In embodiments, the digital musical instrument is a digitally augmented violin.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting. The contents of this section are intended as a simplified introduction to the disclosure and are not intended to limit the scope of any claim.

BRIEF DESCRIPTION OF THE DRAWINGS

With reference to the following description and accompanying drawings.

DETAILED DESCRIPTION

Figure 1:
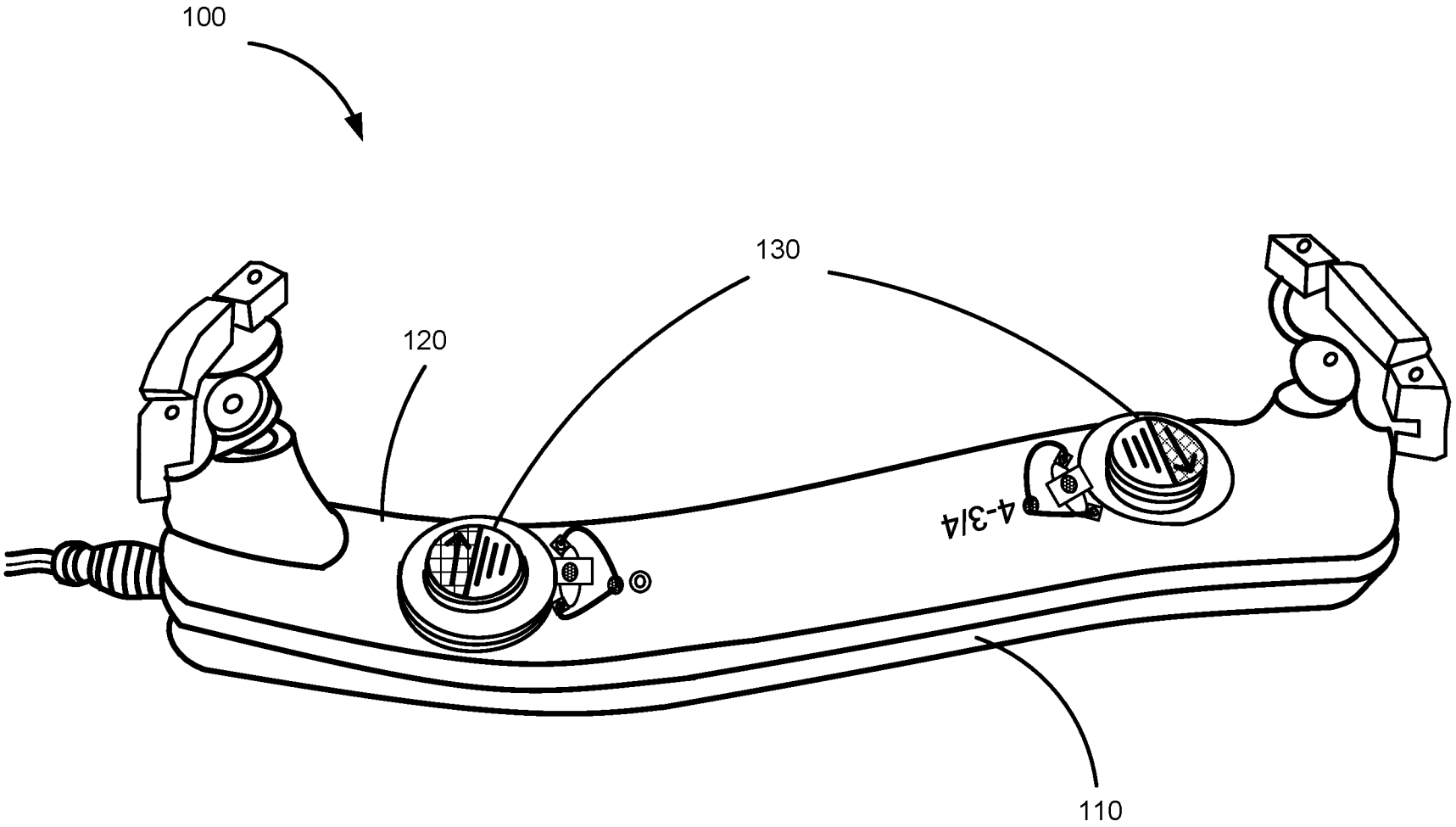
FIG. 1. illustrates a shoulder rest having haptic elements coupled thereto in accordance with an exemplary embodiment.

The following description is of various exemplary embodiments only, and is not intended to limit the scope, applicability or configuration of the present disclosure in any way. Rather, the following description is intended to provide a convenient illustration for implementing various embodiments including the best mode. As will become apparent, various changes may be made in the function and arrangement of the elements described in these embodiments without departing from principles of the present disclosure.

For the sake of brevity, conventional techniques and components for haptic feedback, including speakers, amplifiers, vibrating elements, linkages, actuators, and/or the like may not be described in detail herein. Furthermore, the connecting lines shown in various figures contained herein are intended to represent exemplary functional relationships and/or physical couplings between various elements. It should be noted that many alternative or additional functional relationships or physical connections may be present in exemplary haptic feedback systems and/or components thereof.

Exemplary principles of the present disclosure contemplate use of haptic feedback components and systems, for example, in connection with musical performance. By recovering neglected relationships with the human body and physical world, contemporary design techniques for digital musical instruments (DMIs) have responded to earlier critiques about disembodiment in computer music. Set against a much longer backdrop of industrialization, the incipient period of DMI design was dominated by a controller/generator metaphor in which gestures of effort are exchanged with those of control. The bifurcation of control elements and generative or synthesis elements in DMIs can produce a sense that there is a lack of meaningful physics going on in the controller. On his account, the loss of intimacy may result in haptic feedback that is lacking, results in delays and distortions that can impair gesture response, and causes a lack of sound emanating from the instrument's body.

In contrast to the shortcomings of prior approaches, exemplary principles of the present disclosure contemplate a violin shoulder rest outfitted with voice coils that provides haptic feedback to the violinist. In some embodiments, the shoulder rest with haptic feedback may be used in the field of musical performance, for example in "digital" performance with a violin or viola. In some embodiments, this pertains to an emerging field that takes existing, traditional acoustic instruments and outfits the instrument, the player, or both, with additional sensors, a microphone, or other forms of technology. The audio and/or sensor information captured by these added technologies is, for example, sent to a computer to be processed and subsequently to drive other forms of audiovisual media, which play back on loudspeakers and/or are displayed by video projectors, etc. A complaint is often made by the performer in this situation about a "gap" perceived between the experience of playing the instrument and hearing the audio that it produces emitted on loudspeakers that are far away. An exemplary shoulder rest with haptic feedback solves this problem. In some embodiments, exemplary shoulder rests described herein allow the performer to couple the auditory output of the system with the shoulder rest itself, allowing the performer to "feel" the tactile vibrations of the audio as well as hear them, thereby recreating a traditional performance experience.

Previous approaches for addressing the decoupled sound and physical response of augmented instruments have, in some cases, utilized amplified speakers either near or built into the body of an instrument in order to imbue it with physical meaningfulness for the performer, coupled input and output dynamics, and haptic feedback. In some embodiments, an exemplary shoulder rest described herein contains embedded voice coils that are much more convincing than the compromise of merely placing an amplifier near the violinist.

In some embodiments, by shoring up the conceptual integration of acoustic and digital elements with a materially unified haptic response, an exemplary hybrid violin benefits from the haptic feedback added by an exemplary shoulder rest. Moreover, following the enactive theory of cognition, increasing the multimodal dimensionality of the augmented/hybrid violin may also enhance its performability.

Adding haptic feedback in this way brings the project into the orbit of other projects that have made vibro-tactility thematic in string playing, including the vBow, the virtual cello-like controller, and the BoSSA. It is believed that exemplary embodiments represent the first approach to re-mutualize an augmented/hybrid violin.

A wide variety of shoulder rests are currently marketed to violinists. Considered in the context of the 500-year history of the violin, the shoulder rest is an incipient contraption, its purpose being to raise the violin slightly in order to afford a more ergonomic hold of the violin between the chin and the collarbone, and to provide greater freedom in positional shifting by the left hand.

Whether a violinist should make use of a shoulder rest is topical, with an older generation of virtuosi often advocating for direct contact of the violin with the collar-bone, and a more contemporary consensus (more or less) that different body types (such as endomorphic, meso-morphic, or ecto-morphic) may use different setups to effectively minimize tension in the neck and shoulders. The argument against the shoulder rest may be in part based on a romanticism that, in playing the violin it becomes part of your body. In the context of the present disclosure, the denotative meaning of that statement is obviously well-founded on principles with profound consequences for the experiential quality of DMIs in performance. Physical vibration of the instrument may be a rich source of modal feedback for the performer. Nevertheless, in conventional performance, in some cases, only negligible haptic information is derived from the base of the violin in contact with the body, whether this involves use of a shoulder rest or not. By contrast, the fingertips, which are highly sensitive to haptic information, garner a great deal of feedback from the neck and strings of the violin as well as the bow.

In some embodiments, in the case of the hybrid violin, an intermediary shoulder rest provides a unique opportunity to reintroduce haptic feedback coupled to digitally processed sound.

Figure 2:
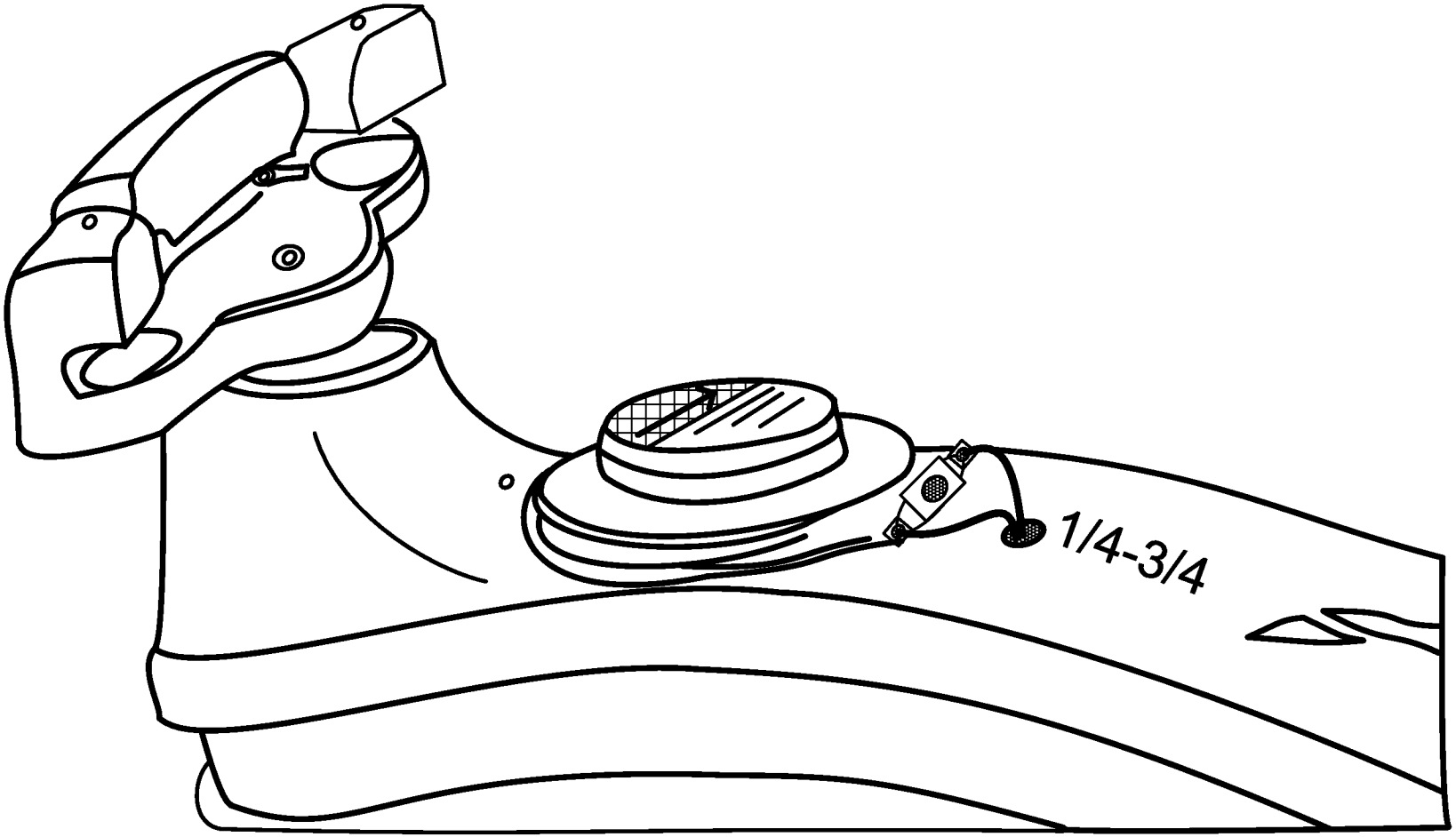
FIG. 2 illustrates a haptic feedback device coupled to a shoulder rest in accordance with an exemplary embodiment.
Figure 3:
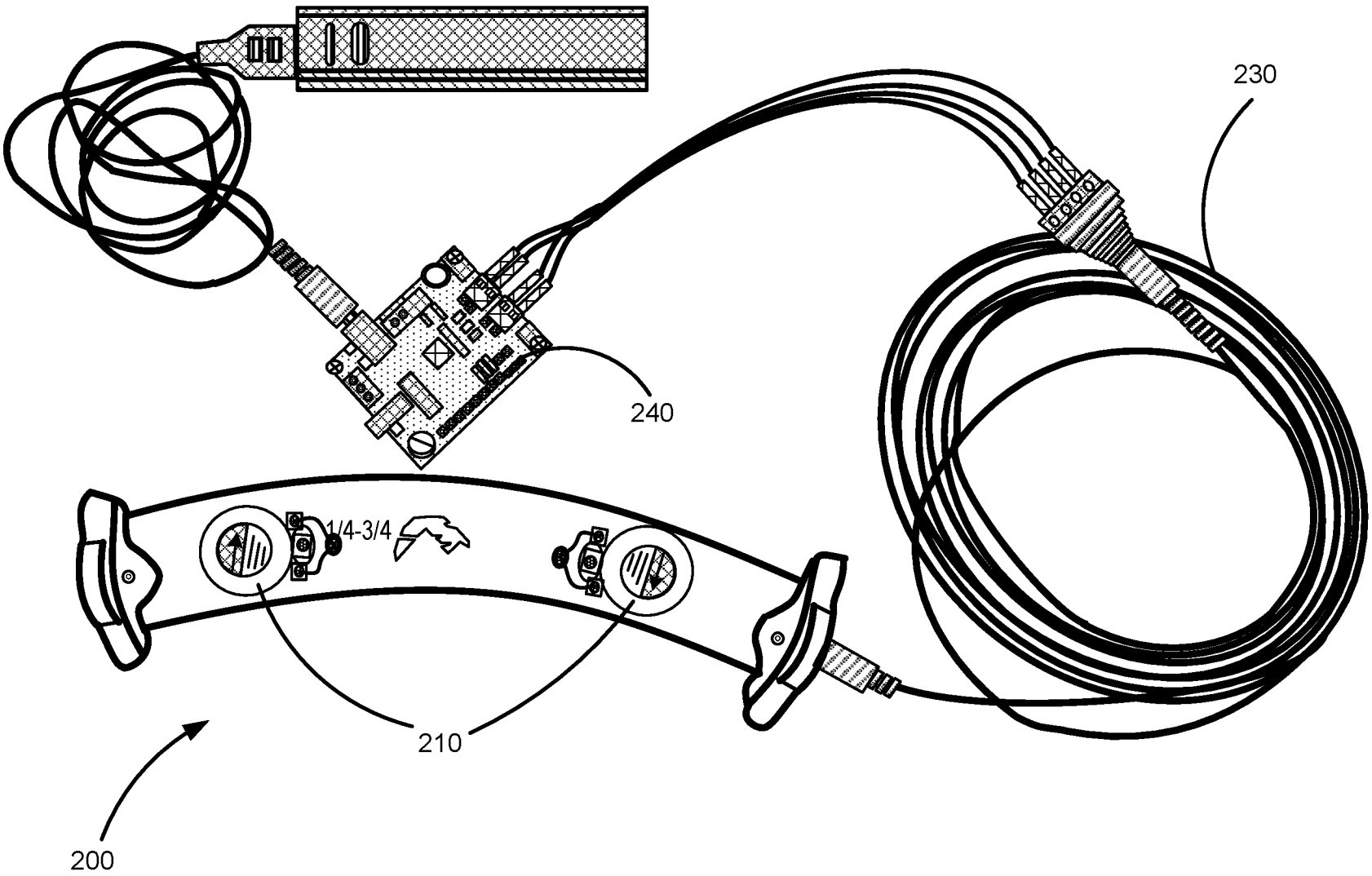
FIG. 3 illustrates components of a haptic feedback system for a musical device in accordance with an exemplary embodiment.

In an exemplary embodiment, and with reference now to FIGS. 1, 2, and 3, the shoulder rest provides an elongated and gently curved surface covered with a dense piece of foam or neoprene. In embodiments, other suitable materials may cover the surface of the shoulder rest. In some embodiments, the pad runs across the shoulder, collarbone and/or upper rib cage. This contouring allows broad contact with the body. In embodiments, the shoulder rest is coupled to the body of the violin and held in place by the friction of rubber-coated feet. In some embodiments, the should rest is coupled to the body of the violin and held in place through use of other suitable materials. Such an exemplary embodiment provides for a shoulder rest that is an ideal candidate for haptic augmentation, as it avoids modifications to the violin itself.

In some embodiments, implementing an exemplary haptic shoulder rest involved modification of a shoulder rest, for example an Everest EZ-4A Violin Shoulder Rest. This model may be selected because of its low cost, excellent grip, and popularity. However, any suitable shoulder rest may be utilized, as desired. These include but are not limited to a Wolf Violin Shoulder Rest, a Mach One Violin Shoulder Rest, or a Kun Shoulder Rest, amongst others. In some embodiments, shoulder rests constructed of plastic are easily etched and engraved, and the smooth slope and flatness of its underside makes it a good candidate for modification. However, shoulder rests made of different types of material can also be used and etched. These materials include, but are not limited to, wood, graphite fiber, or aluminum, amongst others.

In an exemplary embodiment, two flat surfaces at opposite ends of the shoulder rest were etched using a 1+⅛" Forstner drill bit, which is slightly larger than the full diameter of the selected exciters. Two Dayton Audio DAEX13CT-4 Coin Type exciters were then fixed in place using the preinstalled 3M adhesive. However, any suitable size and/or model of exciters may be utilized. During this process it was discovered that the foam on the Everest shoulder rest that was modified could be peeled back and reapplied without damage, thus allowing more rigorous machining. However, other materials may be used that can avoid damage and allow for more rigorous machining. For example, a sponge material, leather, neoprene, or rubber, amongst others, can be used. Two small holes were drilled near the exciters to route their leads to a ⅛" TRRS jack mounted at the end of the shoulder rest. The exciters were chosen because of their 4-ohm impedance and 3-watt rating, which makes them pair well with a small Class D amplifier. Other suitable jacks may be used which include but are not limited to a TS jack and a TRS jack, amongst others. Also, different levels of resistance can be used such as an impedance greater than 4-ohms or an impedance that is less than 4-ohms. Further, different levels of power can be used such as wattage that is less than 3-watts or wattage that is greater than 3-watts. A breakout board produced by Adafruit was chosen that uses a MAX9744 amplifier with a spread spectrum modulation feature that helps to mitigate RF that could emanate from the long speaker wires. Coupled with a 5-volt supply, the amplifier produces two channels of audio output, each with up to 3.7 watts of continuous power at 4 ohms. The use of 28 AWG, 12-foot TRRS cable used to connect the amplifier to the shoulder rest likely adds a small amount of resistance, but it was found that the output power was adequate. Other suitable cables, amplifiers, and related electronic components may be utilized, as desired.

With reference now to FIG. 1, in accordance with an exemplary embodiment, disclosed herein is a shoulder rest that has been modified with a haptic device 100. The shoulder rest contains a foam layer 110 and a plastic layer 120. The foam layer 110 is capable of being pulled back to allow for etching of the plastic layer 120. Subsequent to etching, the foam layer 110 can be reapplied to the plastic layer 120. Two exciters 130 sit at opposite ends of the plastic layer.

With reference now to FIG. 3, in accordance with an exemplary embodiment, disclosed herein is a shoulder rest that has been modified with a haptic device 200. The modified shoulder rest contains exciters 210 and a jack 220 mounted at one end of the shoulder rest. The jack 220 is connected through a cable 230 to an amplifier 240.

In various exemplary embodiments, mechanisms for providing haptic feedback in an exemplary DMI include tactors, piezo-electric elements, voice coils, motors, and solenoids. In one exemplary embodiment, voice coils are utilized because of their wide frequency response, transient response, and ease of control—they can be driven by the same audio signal generated by the DMI. They also afford auditory feedback. In some embodiments, the haptic feedback is in the form of vibration. In some embodiments, the vibration includes vibrotactile feedback. In some embodiments, the vibration includes force feedback to the muscles. In some embodiments, the vibration is combined with auditory information.

In an exemplary embodiment, a TRRS cable connects the shoulder rest to the amplifier. In other embodiments, a TS cable connects the shoulder rest to the amplifier. In some embodiments, a TRS cable connects the shoulder rest to the amplifier. In some embodiments, the audio signal may be provided by the headphone output, for example, of a MOTU Ultralite AVB audio interface. Other suitable headphone outfits may also be used.

When an exemplary shoulder rest with haptic feedback is utilized, it may enhance the integration of the augmented/hybrid violin as a system. In some embodiments, hearing and feeling the digital reflections in one's hands, which were previously limited to the periphery of the ambient stage, intensifies the sensation of being able to "grip" the instrument in a maximal way.

In an exemplary embodiment, audio feedback issues may be managed using a high-pass filter with a gentle roll-off from about 1 kHz. In some embodiments, higher frequencies remain present in the near-field, especially near the left ear of the violinist, which creates the sensation that the digitally processed sound is emanating from the body of the violin, while lower frequencies overlapping with the resonant modes of the violin (which tend to be very strong near the D and A strings) are mitigated, thus circumventing potential feedback issues. Additional tuning using a parametric equalizer or a bank of notch filters may be utilized to further enhance the response and mitigate potential feedback issues.

In various exemplary embodiments, a shoulder rest with haptic feedback may be utilized to generate feedback signals related to instrumental physics as well as transmit symbolically encoded information. For instance, the shoulder rest may be made to pulse at a certain tempo. In improvisatory contexts with other performers, the shoulder rest may receive information encoded as different pulse lengths or counts in order to clandestinely coordinate performance, structure improvised playing, or generate other novel means of interaction among performers.

A violin shoulder rest is an implement that has not previously been explored in the context of augmented violin performance. Converting these devices into digitally, sonically, and/or hapatically active interfaces may provide a nondestructive means of bringing a violin and violinists into the orbit of digital music and new interfaces for musical expression (NIMEs).

In various exemplary embodiments, with the two exciters installed on opposite ends of this exemplary shoulder rest, the violinist can couple a variety of different signals with the shoulder rest that can be felt by the body and/or heard by the player. In some embodiments, the system can be driven by a metronomic pulse, for instance, so that the player can practice to a vibro-tactile pulse rather than an auditory signal. In the context of digital performance, output from the violin recorded and processed by a computer in real-time can be used to drive the exciters, thereby creating a more unified, multimodal performance experience that affords novel experimentation NIMEs.

In various exemplary embodiments, haptic device 100 may be coupled or in communication with external systems and/or resources. For example, haptic device 100 may incorporate a Bluetooth microcontroller for communication with a mobile device application, whereby control, testing, updating, and other advanced features for haptic device 100 may be achieved.

While the principles of this disclosure have been shown in various embodiments, many modifications of structure, arrangements, proportions, the elements, materials and components, used in practice, which are particularly adapted for a specific environment and operating conditions may be used without departing from the principles and scope of this disclosure. These and other changes or modifications are intended to be included within the scope of the present disclosure.

The present disclosure has been described with reference to various embodiments. However, one of ordinary skill in the art appreciates that various modifications and changes can be made without departing from the scope of the present disclosure. Accordingly, the specification is to be regarded in an illustrative rather than a restrictive sense, and all such modifications are intended to be included within the scope of the present disclosure. Likewise, benefits, other advantages, and solutions to problems have been described above with regard to various embodiments. However, benefits, advantages, solutions to problems, and any element(s) that may cause any benefit, advantage, or solution to occur or become more pronounced are not to be construed as a critical, required, or essential feature or element.

As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. Also, as used herein, the terms "coupled," "coupling," or any other variation thereof, are intended to cover a physical connection, an electrical connection, a magnetic connection, an optical connection, a communicative connection, a functional connection, and/or any other connection. When language similar to "at least one of A, B, or C" or "at least one of A, B, and C" is used in the specification or claims, the phrase is intended to mean any of the following: (1) at least one of A; (2) at least one of B; (3) at least one of C; (4) at least one of A and at least one of B; (5) at least one of B and at least one of C; (6) at least one of A and at least one of C; or (7) at least one of A, at least one of B, and at least one of C.

What is claimed is:

1. A shoulder rest for a digital musical instrument, comprising:

a body comprising a rigid or semi-rigid material; and a haptic element comprising a voice coil that is coupled to and directly embedded within the body of the shoulder rest, wherein the haptic element generates a haptic feedback signal responsive to an audio signal generated by the digital musical instrument as a result of a user playing the digital musical instrument during a musical performance, wherein the haptic feedback signal is configured to produce vibrotactile feedback that can be felt by the body of the user during the musical performance.

2. The shoulder rest of claim 1, wherein the digital musical instrument is a digitally augmented violin.

3. The shoulder rest of claim 1, further comprising an amplifier coupled to an input of the haptic element and to an output of the digital musical instrument.

4. The shoulder rest of claim 1, further comprising a second haptic element coupled to the body.

5. The shoulder rest of claim 1, wherein the vibrotactile feedback comprises information encoded as a metronomic pulse at a specific tempo, wherein the metronomic pulse is felt by the body of the user during the musical performance.

6. The shoulder rest of claim 1, wherein the audio signal passes through a high-pass filter, which reduces feedback of low frequency sounds heard by the user during the musical performance.

7. The shoulder rest of claim 1, wherein the body of the shoulder rest contains a plastic layer in which the surface of the plastic layer has been etched, and wherein the voice coil is directly embedded within the etched surface of the plastic layer.

8. A method of providing feedback to a performer utilizing a digital musical instrument, the method comprising:

directly embedding at least one haptic element comprising a voice coil to a shoulder rest;

receiving an output of the digital musical instrument, wherein the output is an audio signal generated by the digital musical instrument during a musical performance;

processing the output to create an input signal for the haptic element; and driving the haptic element, using the input signal, to provide feedback to the performer, wherein the feedback to the performer comprises vibrotactile feedback that can be felt by the body of the performer.

9. The method of claim 8, further comprising providing, to the performer, a metronome pulse via the haptic element.

10. The method of claim 8, further comprising providing, to the performer, a group performance signal via the haptic element.

11. The method of claim 10, wherein the group performance signal comprises at least one of: a key change signal; a tempo change signal; an articulation signal; a volume signal; an improvisation signal; or a song change signal.

12. The method of claim 8, wherein the processing comprises applying a high-pass filter having a roll-off at 1 kHz.

13. The method of claim 8, wherein the input signal varies based on at least one of: harmonic information in the output of the digital musical instrument; amplitude information in the output of the digital musical instrument; phase information in the output of the digital music signal; modulation information in the output of the digital musical instrument; fret noise information in the output of the digital musical instrument; percussive information in the output of the digital musical instrument; or hammer on or pull-off information in the output of the digital musical instrument.

14. A haptic feedback system for a digital musical instrument, comprising:

a shoulder rest comprising at least one exciter fixed on a surface of the shoulder rest, wherein the shoulder rest contains a haptic element comprising a voice coil that is directly embedded within the shoulder rest;

a jack mounted at one end of the shoulder rest; and an amplifier coupled to the at least one exciter through the jack, wherein the at least one exciter is capable of generating haptic feedback signals to a user in response to an audio signal generated by the digital musical instrument during a musical performance by the user playing the digital musical instrument, wherein the haptic feedback signals are configured to produce vibrotactile feedback that can be felt by the body of the user.

15. The haptic feedback system of claim 14, further comprising a computer, wherein output from the digital musical instrument is processed by the computer in real-time, which results in the at least one exciter generating the haptic feedback signals to the user playing the digital musical instrument.

16. The haptic feedback system of claim 14, wherein the at least one exciter is capable of receiving a metronomic pulse, which results in the at least one exciter generating the haptic feedback signals to the user playing the digital musical instrument.

17. The haptic feedback system of claim 14, wherein the at least one exciter fixed on the surface of the shoulder rest comprises two exciters fixed on the surface of the shoulder rest.

18. The haptic feedback system of claim 14, wherein the digital musical instrument is a digitally augmented violin.

* * * * *